US005184434A

United States Patent [19]

Hollinger et al.

[11] Patent Number: 5,184,434

[45] Date of Patent: Feb. 9, 1993

[54] PROCESS FOR CUTTING WITH COHERENT ABRASIVE SUSPENSION JETS

[75] Inventors: Richard H. Hollinger; William D. Perry, both of San Antonio, Tex.

[73] Assignee: Southwest Research Institute, San Antonio, Tex.

[21] Appl. No.: 574,665

[22] Filed: Aug. 29, 1990

[51] Int. Cl.[5] ..... B24C 1/00

[52] U.S. Cl. ..... 51/317; 51/319; 51/321

[58] Field of Search ..... 51/317, 320, 321, 410, 51/436, 439

[56] References Cited

U.S. PATENT DOCUMENTS

| | | | |
|---|---|---|---|
| 4,319,435 | 3/1982 | Suzuki et al. | 51/436 |
| 4,517,774 | 5/1985 | Dudding | 51/436 |
| 4,555,872 | 12/1985 | Yie | 51/321 |
| 4,707,952 | 11/1987 | Krasnoff | 51/436 |
| 4,723,387 | 2/1988 | Krasnoff | 51/436 |

*Primary Examiner*—M. Rachuba
*Attorney, Agent, or Firm*—Gunn, Lee & Miller

[57] ABSTRACT

A process for the forming and use of a coherent abrasive suspension jet, which involves treating water with additives to give the water a high shear dependent viscosity or viscoelasticity, or a moderate yield value, and suspending fine, abrasive particles within the treated water. The suspension that is formed may be retained in a reservoir prior to use, and requires no agitation or stirring as a slurry solution would require. The suspension that is formed allows for the use of an abrasive jet nozzle that requires only a single supply conduit and requires no mixing chamber, collimating cone, or collimating tube, as conventional jets require. The coherent abrasive suspension jet medium allows for the use of much lower pressures, much finer orifices, and much simpler operations. The process overcomes many of the difficulties associated with the reduced velocities and increased jet diameters that are attained by conventional abrasive jets.

10 Claims, 4 Drawing Sheets

PROCESS FOR CUTTING WITH COHERENT ABRASIVE SUSPENSION JETS

BACKGROUND OF THE INVENTION

1. Field of the Invention

This invention relates generally to processes for producing and utilizing small diameter jets of high pressure fluid with entrained abrasive particles as abrasive tools. This invention relates more specifically to processes for the forming and use of small diameter coherent abrasive suspension jets of high pressure fluid with entrained abrasive particles directed to the cutting of materials.

2. Description of Related Art

Jets of high pressure fluid have been used for over 100 years in mining to wash ore bearing gravel from cliffs and stream banks. More recently, using pressures up to 55,000 psi, water jets have been used to cut materials that are ordinarily cut with knives, shears or saws. The entrainment of abrasive particles in these water jets has permitted cutting of hard materials such as steel, concrete, and lightweight composites.

In a typical water/abrasive jet system, abrasive particles are entrained in the water jet after the jet is formed by an orifice. The water jet and entrained particles are then collimated by a director or focusing tube and are allowed to impinge on a target. In the entrainment process, mixing inefficiencies prevent the abrasive particles from being accelerated to jet velocity. The velocity of the final jet is further inhibited by the director tube, because the director tube typically has a larger diameter than the orifice which forms the jet, resulting in jet dispersion and a reduction of the jet velocity.

There are, therefore, two primary disadvantages to the method of entraining abrasive particles after the jet is formed. First, the jet leaves the abrasive mixing head at a velocity significantly below the initial velocity of the primary jet. Second, the mixing requires that there be some dispersion of the initial primary jet and the process of recollimating and focusing the mixed flow necessarily fails to achieve the narrower cross section of the primary jet orifice. These two disadvantages will be discussed in more detail below.

There are a number of derivative disadvantages to the method of entraining the abrasive after the jet is formed. Ordinarily, abrasive water jet cutting, in which a dry abrasive is fed into a mixing chamber and combined with the water jet, produces sparking, especially on the back side of a metal target when the jet has struck through. This sparking has been sufficient to discourage the use of abrasive jet cutting in hazardous atmospheres. It has been found, however, that no sparking occurs when the abrasive is introduced into the mixing chamber of the jet head already in a fluid mixture. Apparently, dry abrasives are not fully wetted by the jet and can strike sparks, while wetted abrasives transfer sufficient energy to the absorbed water to prevent sparking. It has also been found that feeding dry abrasive in a conventional jet leads to static build up in the feed line, and sometimes leads to static discharge.

An additional disadvantage to a conventional water/abrasive jet is that it can not be used under water without much difficulty. Two factors create this difficulty. First, the abrasive feed must be pressurized to prevent ambient water from rising into the mixing chamber, and second, the secondary jet with entrained abrasive tends to break up while traversing ambient water. For these reasons, the jet must work very close to the surface being cut.

The structure of a conventional water/abrasive jet nozzle is shown in FIG. 1. High pressure water flow 1 enters the conventional jet head by way of inlet tube 2. Dry abrasive flow 7 enters the conventional jet head by way of feed hose 8. High pressure water flow 1 is forced through orifice 3 and results in primary water jet 4. Orifice 3 is typically made of sapphire (or other hard material) and is on the order of 0.01–0.05 inches in diameter. Primary water jet 4 combines with dry abrasive flow 7 in chamber **4*a* where it is focused by tungsten carbide focusing cone 5, and further collimated by tungsten carbide focusing tube 6. This results in a collimated jet 9** of water and aspirated abrasive. A sapphire orifice is used to create the high velocity, primary jet of water, because of its ability to withstand wear. Typical pressures for water flow in the primary jet range from 14,000 to 55,000 psi. The abrasive, which is usually garnet sand, is aspirated into the mixing chamber by the action of the jet, mixed with the jet, and the two are reformed into a secondary, lower velocity jet by means of the focusing cone and focusing tube.

The velocity of the collimated, secondary jet may be increased by increasing the water flow to the primary jet. This increased water flow may be achieved by using a larger diameter orifice, a higher driving pressure, or both. The use of smaller diameter focusing tube may also be used to increase the velocity of the secondary jet If the water pressure is made to increase, then depending upon the primary jet flow and the focusing tube diameter, water may enter the abrasive feed line and stop the abrasive flow. Accurate alignment of the focusing tube with a center line of the primary jet is required in order to obtain a well collimated secondary jet and to decrease tube wear. Inefficiencies created by the momentum exchange between the primary jet and the abrasive particles reduce the cutting efficiency of the collimated jet. There are, therefore, certain inherent limits to the primary jet pressure and to the focusing tube diameter (and thus the secondary jet velocity) that prevent such mixing head devices from overcoming the primary disadvantages mentioned above.

The overall complexity of such mixing head type abrasive jet systems can itself become a problem. While the primary jet orifice can be very small and compact, the mixing head assembly requires in addition to the orifice a mixing chamber, collimating cones and tubes, and most importantly, two feed lines. Besides the problems associated with increased nozzle size, the necessity of a second supply line that is capable of transporting abrasive particles can often mean the difference between a practical application and one that is impractical.

Apart from the inherent complexities of a mixing type jet head, the process of entraining particles in the jet stream after its formation also implies a more complex supply system. While providing high pressure water as a working fluid at a mixing head is relatively simple, the supply of dry or slurried abrasive particles can be anything but straight forward. Dry abrasives most often are conducted by a gas stream, which must not only be produced and maintained, but must be dealt with at the point of mixing with the primary jet stream. Slurried abrasive streams must generally be agitated in order to prevent settling and to maintain a proper flow through to the mixing head. More recent attempts at conducting abrasive particles in a foam medium have improved abrasive flow but have not reduced the complexity required by the second supply line to the mixing head.

A typical conventional water/abrasive jet, as described above, operating at a pressure of 30,000 psi, with an orifice diameter of 0.01 inch, will cut 0.25 inch thick steel with a traverse speed of approximately 4" per minute, a jet power of approximately 6.15 hp, and a resultant jet work per inch cut of approximately 1.53 hp-minute per inch. Such conventional jets typically consume abrasives on the order of 0.6 lbs. per minute with a resultant 0.15 lbs. per inch abrasive consumption. Typical water use for a conventional jet is 20 cubic inches of water per inch of cut.

If the mixing of the abrasive and working fluid could be accomplished prior to the formation of the primary jet at the orifice, then both the fluid and the abrasive could be expelled from the orifice at the same velocity. In such a system, a focusing tube would no longer be required and the abrasive jet would impinge directly on the target. Cutting efficiency would be increased because of the higher abrasive particle velocities, and the narrower jet cross section.

The inability to accomplish this premixing of the abrasive and working fluid has resulted primarily from an inability to maintain the abrasive in a suspended, transportable state within the fluid. Various methods of forming slurries and/or foams with abrasives have overcome some of the problems associated with the pumping and transport of the abrasive to the jet nozzle, as described above, but none of these processes have achieved the capability of transporting a fully mixed working fluid through jet orifices smaller than 0.020" in diameter. Most such previous attempts have continued to rely on the more complex structure of a mixing type nozzle, wherein a high pressure water flow is made to combine with a lower pressure slurry or foam abrasive mixture flow. While certain disadvantages described above are overcome with slurry and foam mixture flows, ultimately the two problems which most severely effect the function of an abrasive jet, namely loss of velocity and loss of coherence, remain problems because of continued requirement of post jet mixing and secondary collimation.

SUMMARY OF THE INVENTION

In order to impart as much as possible of the primary velocity of an abrasive jet to the abrasive particles, it would be desirable to suspend the abrasives within the working fluid prior to the jet formation. The present invention provides a method whereby this suspension is accomplished. To achieve mixing of the water and abrasive prior to the forming of the jet, suitable polymeric materials are mixed with the working fluid water to achieve an increased fluid viscosity, and with some materials a high viscoelasticity, which is shear dependent, or to create a fluid having a moderate yield value. The particulate abrasive materials are thus prevented from settling and the jet formed through an orifice is coherent rather than divergent. A coherent abrasive suspension jet cuts more efficiently, both because the coherent jet exerts its force over a smaller area, and because the abrasive particle velocity is higher. As an additional advantage, cuts made with coherent abrasive suspension jets show narrower kerf widths.

In the present invention, the abrasive particles are suspended in polymer thickened water, and the resulting suspension is pumped directly through a jet forming orifice. A diagram of a jet head suitable for the present invention is shown in FIG. 2. Work with the coherent abrasive suspension jet has shown it to have better cutting efficiency than the conventional jet, while at the same time, using less abrasive, lower power, and lower pressures.

A part of the abrasive suspension jet's higher efficiency comes from the higher abrasive particle velocity, but a large part of the efficiency comes from the coherence of the jet, which allows the energy of the jet to be brought to bear on a much smaller area of the target. This is done without the necessity Of collimation as with the conventional jet, all of which makes the setup and aiming of the suspension jet much easier. Once set up, the suspension jet is not subject to misalignment as is the focusing tube of a conventional jet. Conventional jets using aspiration feed are not typically capable of making very narrow cuts, since they are limited by the diameter of the focusing tube and the inability to feed fine sized abrasive. On the other hand, the suspension jet allows cuts as narrow as 0.003" to 0.004" to be made using 10 micrometer diameter abrasive particles.

While most water/abrasive jets require high pressures and use complicated jet heads (see discussion above), the coherent abrasive suspension jet is capable of operating at more moderate pressures, which allow for a lighter weight, less complex system, and lower horse power utilization. While pressures in a coherent abrasive suspension jet can typically range from 5,000 to 15,000 psi, there are no upper or lower pressure limits, assuming compatible abrasive grades and orifice diameters are utilized. The suspension jet does not require a complicated jet head, and since it requires no focusing tube, the kerf widths in a suspension jet can approach 0.003" to 0.004". This compares with a minimum of nearly 0.031" for kerf widths produced by focusing tube type water abrasive jets.

Typical parameters achievable by the use of a coherent abrasive suspension jet are significantly better than those parameters encountered with a conventional jet. A suspension jet functioning at 7,500 psi through a 0.01" orifice can cut 0.25" thick steel with a traverse speed of 2" per minute, will have a jet power of 0.88 hp, and a resultant jet work per inch cut of 0.44 hp-minute per inch. The abrasive consumption of such a coherent abrasive suspension jet is 0.18 pounds per minute with a resultant 0.09 pounds of abrasive per inch of cut. The water use of such a suspension jet is typically 24.6 cubic inches per inch of cut.

The primary advantages of the process for cutting with a coherent abrasive suspension jet involve its ability to make extremely fine cuts through the use of a very small orifice and to make these cuts using significantly lower pressures. The coherent abrasive suspension jet utilizes a viscous or viscoelastic suspension that maintains the abrasive in an even distribution throughout the liquid so that it might easily be pumped and passed through the orifice already mixed.

With a coherent abrasive suspension jet, the abrasive particles are fully wetted by the water based suspending medium and are surrounded by the water based continuum. Therefore, there is no possibility of air entrainment in the jet as in the case of the conventional jet with dry feed or, less so with slurry feed. Sparking has, therefore, not been observed with the coherent abrasive suspension jet when used on steel, aluminum or glass. Sparking has been observed with titanium, but considerably reduced from that obtained with the conventional jet.

With the coherent abrasive suspension jet, no delicate pressure balance needs to be maintained when it is utilized under water, since there is no mixing chamber to be contaminated by the ambient water. In addition, the properties of the viscous or viscoelastic suspending medium prevent the jet from breaking up while traversing ambient water, and more latitude in stand off distances is permitted.

DETAILED DESCRIPTION OF A PREFERRED EMBODIMENT

Preventing the abrasive that is to be suspended in the working fluid from settling is one of the primary goals and advantages of this system. It results in the ability to pump the suspension solution directly through an orifice and eliminates the requirement of adding the abrasive at a later stage or of constantly stirring or agitating a slurry of the abrasive.

Previous working fluid additives have, for the most part, amounted to little more than 0.3 percent solutions with water. The primary purpose of these additives in the past has been to reduce the drag of the water solution through the orifice. The viscosity of such a solution created is on the order of 400 centipoise. The 1.3 percent, or more, solution that is utilized in the present invention, however, increases that viscosity to more than 9,000 centipoise.

A preferred embodiment of the present invention uses a methyl cellulose/water mixture as the viscous medium within which to suspend the abrasive particles. (The abrasive particles are generally 75 to 106 micron particles of garnet).

Using a viscoelastic fluid improves the function of the system even further. A typical viscoelastic fluid is marketed by Berkeley Chemical Company under the brand name "Superwater" and is a methacrylamide/water mixture.

The increased viscosity of the working suspension fluid, serves primarily to prevent the settling of the abrasive within the solution. The high viscosity also serves to maintain the coherency of the abrasive suspension jet after passing through the jet head orifice. High viscoelasticity provides all of these advantages along with the additional advantage of elasticity upon impact with the target. Whereas a simple viscous fluid might tend to fly apart upon impact with a target, a viscoelastic fluid maintains its collimated jet configuration to a greater extent. Both viscous fluid and viscoelastic fluids, however, achieve the primary goals of the present invention, namely increased jet particle velocities and decreased jet profile cross section.

Figure 1:
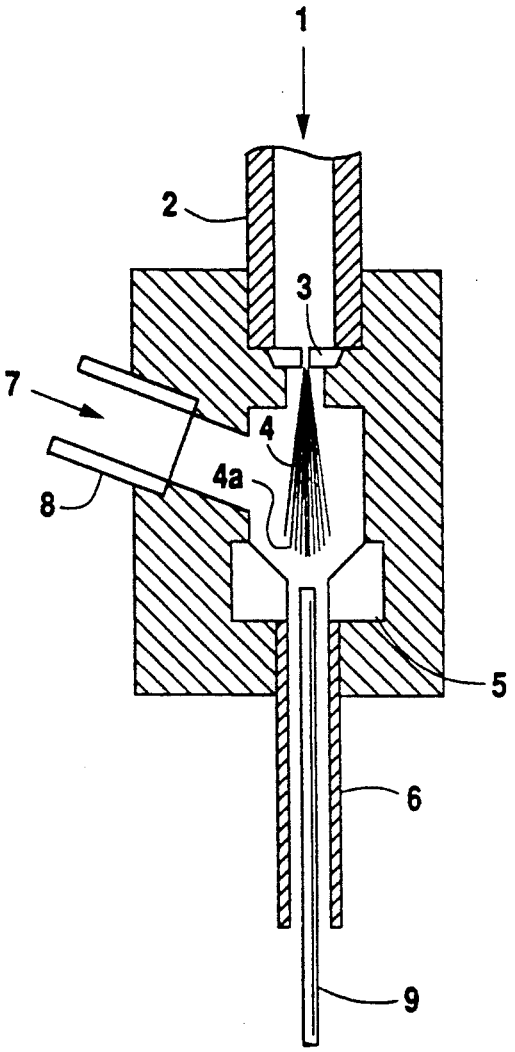
Fig. 1 ( PRIOR ART )
FIG. 1 is a cross sectional diagram of the mixing jet head typically found in the prior art.

FIG. 1 discloses the standard jet nozzle configuration disclosed by a number of previous abrasive jet devices and methods. This configuration is described in more detail above with reference to prior designs.

Figure 2:
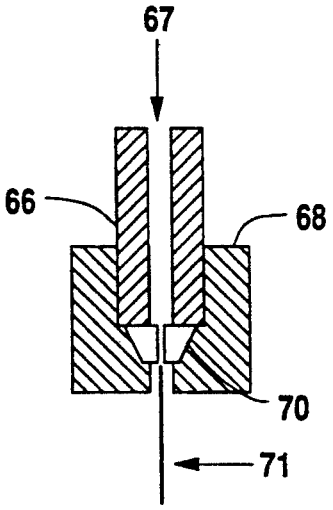
FIG. 2 is a cross sectional diagram of the jet head of the present invention.

Reference is now made to FIG. 2 for a detailed view of the type of jet nozzle required for the present invention's use of a water/abrasive suspension. The jet itself is simple and requires only a single inlet tube 66, which conducts a flow of medium pressure coherent abrasive suspension jet fluid 67 to orifice holder 68. Orifice holder 68 retains diamond orifice 70, which typically has an orifice opening on the order of 0.003 to 0.020 inches. Medium pressure coherent abrasive suspension jet fluid 67 is forced through diamond orifice 70 and results in coherent abrasive suspension jet 71. Because of the nature of the coherent abrasive suspension jet fluid, no mixing is required and no further collimation of the jet is needed.

Figure 3:
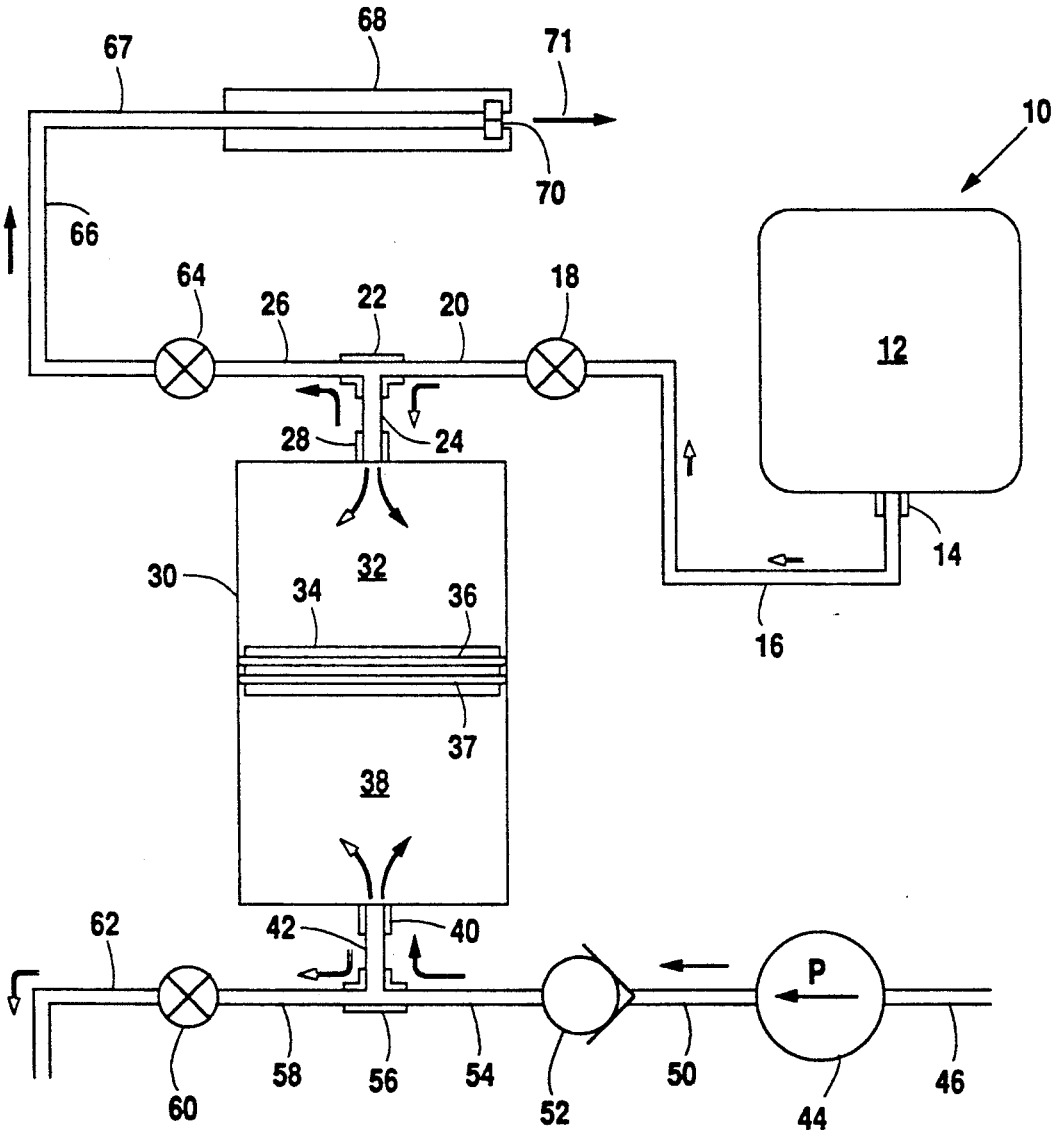
FIG. 3 is a schematic diagram of a preferred embodiment of the present invention in a direct discharge method configuration.

Reference is now made to FIG. 3 for a more general view of a system within which a coherent abrasive suspension jet fluid may be created and transported to a jet nozzle. Coherent abrasive suspension jet fluid 12 is retained in liquid suspension tank 10, and is forced to flow into the system by an appropriate means (using compressed air to displace from suspension tank 10 for example) via suspension tank outlet 14 and suspension tank conduit 16. This flow out of suspension tank is regulated by suspension charging valve 18. When suspension charging valve 18 is open, coherent abrasive suspension jet fluid 12 may be forced to flow into suspension charging conduit 20, through conduit T connector 22, through suspension cylinder conduit 24, through suspension cylinder port 28, and finally into floating piston cylinder 30.

Cylinder 30 is a dual chamber cylinder with freely floating piston 34 dividing suspension cylinder chamber 32 from intensifier cylinder chamber 38. Floating piston 34 retains upper O ring seal 36 and lower O ring seal 37, which ensure no conduction between the fluids in suspension chamber 32 or intensifier chamber 38.

Intensifier medium 46 is high pressure water in the preferred embodiment, and is maintained in the system by way of intensifier pump 44 at a pressure of up to 55,000 psi. Intensifier medium 46 is conducted from intensifier pump 44 by way of intensifier pump conduit 50, and is controlled in its flow by intensifier check valve 52. When open, intensifier check valve 52 allows the flow of intensifier medium 46 through intensifier pressure conduit 54, conduit T connector 56, intensifier cylinder conduit 42, and finally through intensifier cylinder port 40 into intensifier cylinder chamber 38.

When system valves 18, 52, 60, and 64 are appropriately configured, intensifier medium 46 may be expelled from intensifier chamber 38, through intensifier cylinder port 40, intensifier cylinder conduit 42, depressurization conduit 58, open depressurization valve 60, and finally through depressurization outlet conduit 62.

For coherent abrasive suspension jet fluid 12 to be discharged out of suspension cylinder chamber 32, suspension outlet valve 64 is opened, and coherent abrasive suspension jet fluid 12 flows out of suspension cylinder port 28, through suspension cylinder conduit 24, conduit T connector intensified suspension conduit 26, open suspension outlet valve 64, and finally through suspension outlet conduit 66. Suspension outlet conduit 66 carries pressurized coherent abrasive suspension jet fluid 67 to orifice holder 68, and finally through orifice 70 to form jet 71.

The system described in FIG. 3 requires that floating piston cylinder 30 be initially charged in order to begin a flow of coherent abrasive suspension jet fluid 12. The charging of floating piston cylinder 30 with suspension 12 is accomplished by opening suspension charging valve 18, closing suspension outlet valve 64, opening depressurization valve 60, and closing intensifier check valve 52. In this configuration, a minimal pressure (compressed air for example) on coherent abrasive suspension jet fluid 12 forces it to flow out of suspension tank 10 in the manner described above, into suspension cylinder chamber 32. This forces floating piston 34 in a downward direction, increasing the volume of suspension cylinder chamber 32, and decreasing the volume of intensifier cylinder chamber 38. This forces the depressurized intensifier medium 46, present within intensifier cylinder chamber 38, out through open depressurization valve 60 as described above. Intensifier medium 46 is then drained and removed from the system by way of depressurization outlet conduit 62.

Once floating piston cylinder 30 has been charged with coherent abrasive suspension jet fluid 12, the reverse discharge process may occur. For this process, suspension charging valve 18 is closed, suspension outlet valve 64 is open, depressurization valve 60 is closed, and intensifier check valve 52 is open. In this configuration, intensifier medium 46 is forced, by intensifier pump 44, to flow through intensifier check valve 52 into intensifier cylinder chamber 38 as described above. This higher pressure intensifier medium 46 flowing into intensifier cylinder chamber 38 causes floating piston 34 to be displaced upward through floating piston cylinder 30. This decreases the volume of suspension cylinder chamber 32, and forces pressurized suspension 67 out of floating piston cylinder 30 through suspension outlet valve 64 at the pressure of intensifier fluid 46 as described above. From outlet valve 64, pressurized suspension 67 flows through suspension outlet conduit 66, through orifice holder 68, through orifice 70, and is finally dispersed as shown in FIG. 2 as coherent abrasive suspension jet 71.

Figure 4:
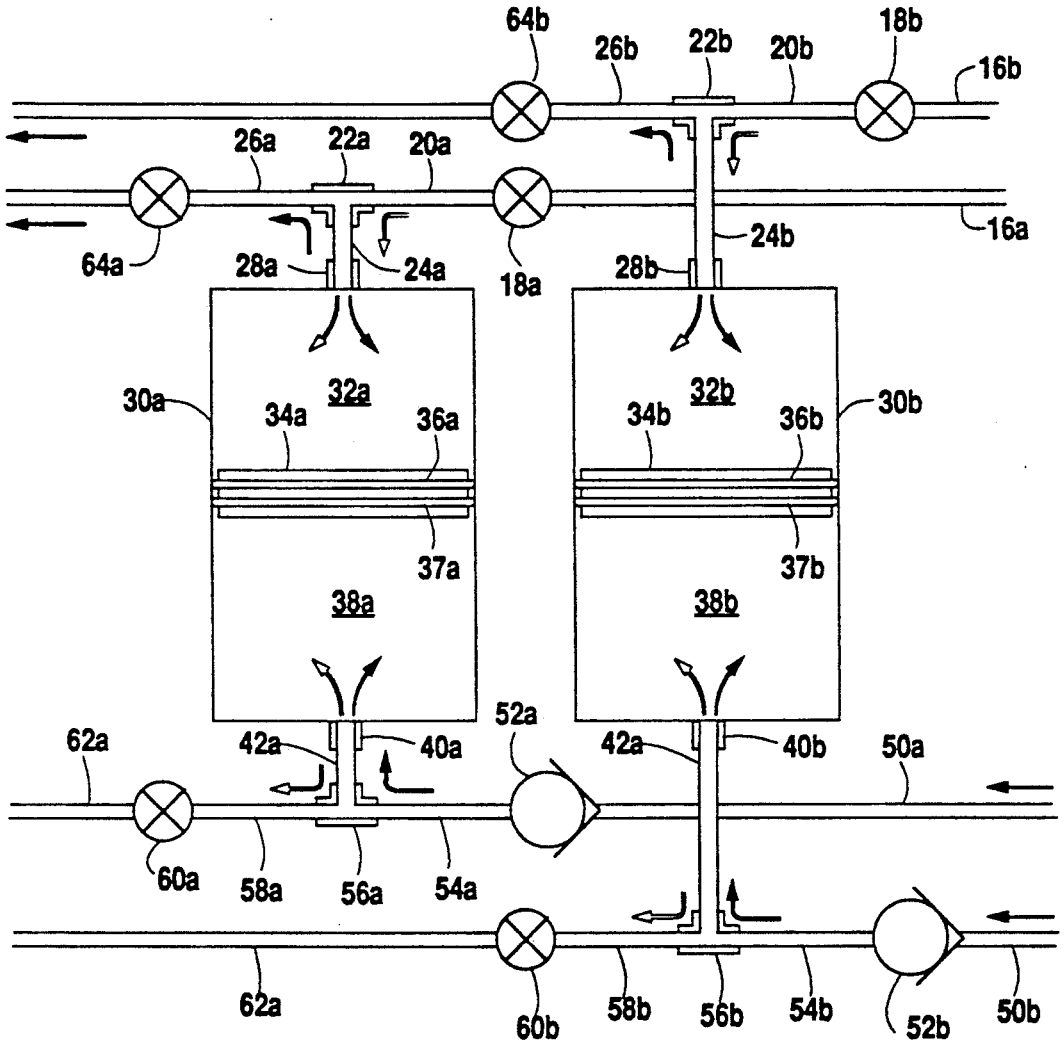
FIG. 4 is a schematic diagram of an alternative embodiment of the configuration described in FIG. 3, in which an additional parallel discharge cylinder is disclosed.

An alternative embodiment of the system shown in FIG. 3 that incorporates a parallel second floating piston cylinder is shown in FIG. 4. The components of this parallel system are identical to those described in FIG. 3, and the numbers associated with their identity are repeated in FIG. 4 with sub-indications "a" and "b" for clarity. The arrangement in FIG. 4, is capable, with appropriate switching of valves, of maintaining a constant flow of coherent abrasive suspension jet fluid, while at the same time, recharging the system. This is accomplished in the following manner.

Assuming first an initial state wherein cylinder **30*a* is charged and cylinder 30*b* is discharged. With valves 52*a*, 60*b*, 18*b*, and 64*a* open, and with valves 60*a*, 52*b*, 64*b*, and 18*a* closed, cylinder 30*a* is faced with intensifier pressure within intensifier chamber 38*a* by way of open valve 52*a*. This forces floating piston 34*a* upward, which in turn forces coherent abrasive suspension jet fluid 12 out from cylinder suspension chamber 32*a* by way of valve 64*a*. At the same time, cylinder 30*b* is recharging as coherent abrasive suspension jet fluid 12 is allowed to flow through valve 18*b* into suspension chamber 32*b*, forcing floating piston 34*b* downward whereby it forces intensifier medium 46 from intensifier chamber 38*b*, out by way of open valve 60*b* eventually to depressurization outlet conduit 62*b***.

When cylinder **30*a* approaches being fully discharged and cylinder 30*b* approaches being fully charged, valves 18*b* and 60*b* are closed. This isolates cylinder 30*b* momentarily. Valve 52*b* is then opened, which pressurizes cylinder 30*b* by allowing it to see the intensifier medium by way of open valve 52*b* into chamber 38*b*. Valve 64*b* is then opened, which places both cylinder 30*a* and 30*b* in a discharge configuration. While both cylinders 30*a* and 30*b* are discharging, valve 64*a* is closed so as to discontinue the discharge from cylinder 30*a*. Valve 52*a* is then closed so as to isolate cylinder 30*a*, and allow the process of recharging cylinder 30*a* to occur. This process is initiated by opening valve 60*a*, which allows the depressurization of chamber 38*a* and the flow of the intensifier medium therefrom. At the same time, valve 18*a* is opened to allow for the corresponding flow of coherent abrasive suspension jet fluid 12 into suspension chamber 32*a*. All the while, cylinder 30*a* is recharging, cylinder 30*b* continues to discharge coherent suspension fluid 12** through orifice jet (not shown).

The same sequence of valve openings and closings occurs when cylinder **30*a* has been fully charged, and cylinder 30*b* is nearing full discharge. This transition sequence of discharging and charging of cylinders 30*a* and 30*b* can be carried on indefinitely, as long as coherent abrasive suspension jet fluid 12 is supplied by way of suspension supply tank 10, and as long as intensifier medium 46 is provided by way of intensifier pump 44**.

Figure 5:
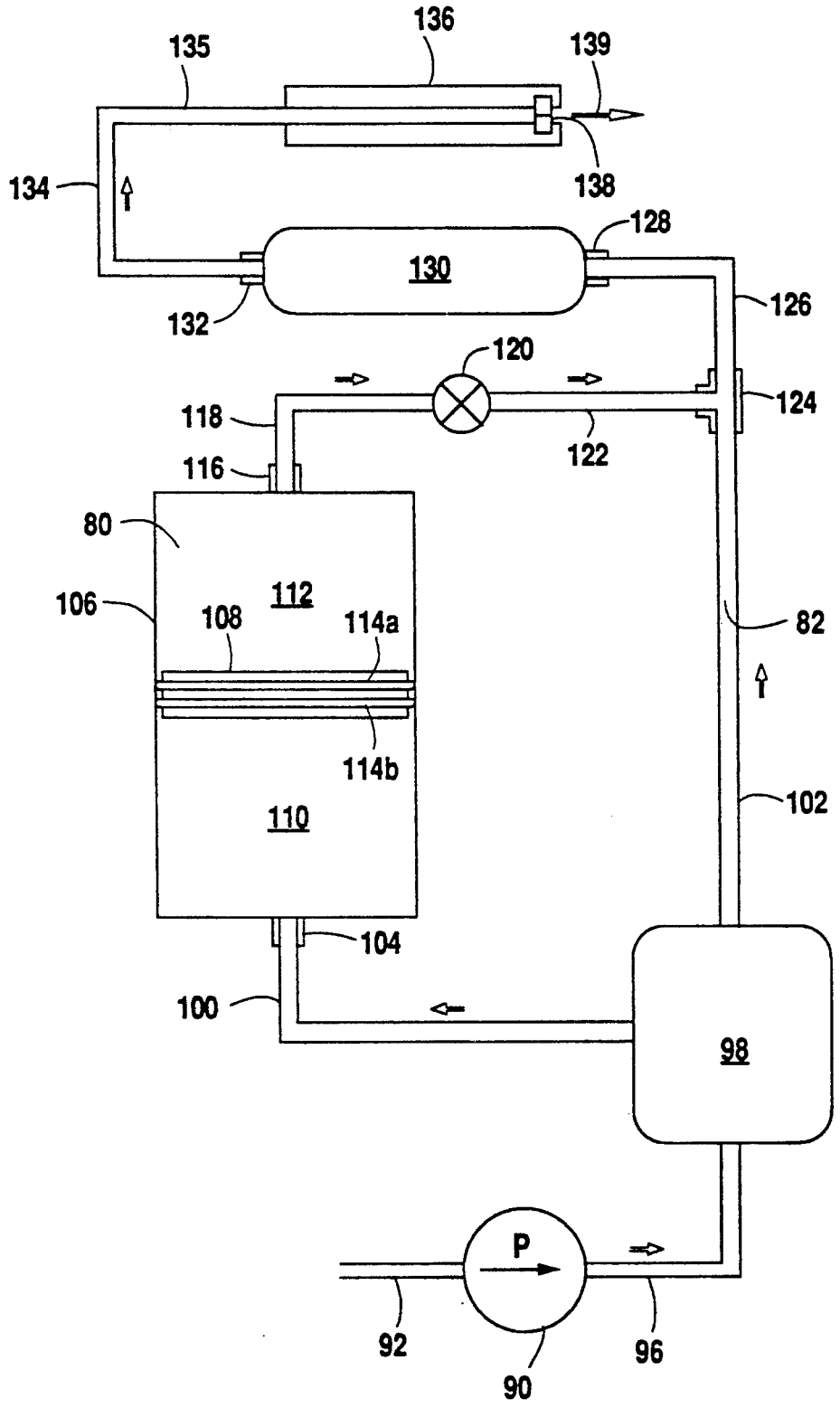
FIG. 5 is a schematic diagram of an alternative embodiment of the present invention in an indirect discharge method configuration.

Reference is now made to FIG. 5 for another method of extending the time over which a flow of pressurized coherent abrasive suspension jet fluid 67 through jet orifice 70 can be maintained. In FIG. 5, there is once again only a single floating piston cylinder 106 in the system. In this configuration, floating piston cylinder 106 is initially charged with a highly concentrated coherent abrasive suspension jet fluid 80. This highly concentrated suspension 80 is placed within suspension concentrate chamber 112 of floating piston cylinder 106. Floating piston cylinder 106 is, in all respects, identical to the floating piston cylinders described above with regard to FIGS. 3 and 4. The system described in FIG. 5, additionally includes intensifier pump 90 which pumps intensifier medium 92, which in the preferred embodiment is high pressure water.

Intensifier medium 92 is forced to flow into the system by intensifier pump 90, by way of intensifier outlet 94, and through intensifier supply conduit 96. Intensifier medium 92 is then used for two purposes. First, intensifier medium 92 is conducted by way of pressure compensated flow proportioning valve 98 to floating piston cylinder 106 by way of intensifier cylinder conduit 100 and cylinder pressure inlet 104. As in the configurations described above, this high pressure water, as intensifier medium 92, is allowed to flow into intensifier chamber 110 of floating piston cylinder 106, and displaces floating piston 108 upward within cylinder 106, thereby discharging partially pressurized coherent abrasive suspension jet fluid concentrate 80 from suspension concentrate chamber 112.

Second, intensifier medium 92 is conducted by way of pressure compensated flow proportioning valve 98 to working fluid conduit 102, where it becomes working fluid 82. Pressure compensated flow proportioning valve 98 may be adjusted to proportion intensifier medium (high pressure water) 92 between intensifier cylinder conduit 100 and working fluid conduit 102.

If the concentration of suspension 80 requires a dilution of 4:1, for example, prior to its discharge through orifice 138, then pressure compensated flow proportioning valve 98 provides a 4:1 ratio in the pressures between intensifier cylinder conduit 100 and working fluid conduit 102. This produces a pressure on coherent abrasive suspension jet fluid 80 within chamber 112, one-fourth that of the pressure on working fluid 82 in working fluid conduit 102. Therefore, when these two fluids 80 and 82 combine and are eventually mixed in in-line mixer 130, they are mixed in a ratio of one part coherent abrasive suspension jet fluid concentrate 80 to four parts working fluid 82.

The flow of concentrated coherent abrasive suspension jet fluid 80 is controlled by way of shut off valve 120, which conducts concentrated suspension 80 from suspension concentrate chamber 112 by way of suspension concentrate outlet port 116, and suspension concentrate outlet conduit 118. Concentrated suspension 80 then combines with working fluid 82 in working fluid conduit 102 by way of concentrate suspension conduit 122. Mixing conduit 126 connects the two fluid sources to in-line mixer 130 by way of mixing inlet port 128. In-line mixer 130 is a typical ribbon or vortex mixer, and appropriately homogenizes working coherent abrasive suspension jet fluid 135 for discharge through jet orifice 138. Fluid 135 leaves in-line mixer 130 by way of in-line mixer outlet port 132, and is conducted to orifice holder 136 by way of mixed suspension conduit 134. From within orifice holder 136, fluid 135 is discharged by way of orifice 138, resulting in the formation of jet 139.

In this manner, because of the slower rate at which the concentrate necessarily must be fed from the charged cylinder, a jet flow of longer duration may be achieved. While this system does not allow for an indefinite flow of abrasive suspension fluid as does that system described in FIG. 4, it does significantly increase the time period over which the abrasive jet may be used without interruption. In many cases, this is entirely sufficient for a particular application.

A typical application of this type of abrasive jet is in the precision cutting of quartz wafers. Quartz wafers on the order of 0.006" in thickness, have been cut using a suspension of 10 micrometer diameter alumina abrasive and a 0.003" diameter diamond orifice. Optimum cutting speed was 0.5" per minute at only 5,000 psi. Cuts with kerf widths of 0.003" to 0.004" spaced 0.011" apart, have been achieved.

While the foregoing discussion of the present invention has described the process in relation to certain preferred embodiments, and specific details have been disclosed for the purpose of illustration, it will be apparent to those skilled in the art that the invention is open to additional embodiments and that the details of the descriptions above could be altered considerably without departing from the basic principles of the invention.

I claim:

1. A process for producing and utilizing an abrasive suspension jet stream, said process comprising the steps of:

forming a coherent abrasive suspension jet fluid comprising in combination water, abrasive particles, and a water soluble material which increases the viscosity of said coherent abrasive suspension jet fluid to a level sufficient to prevent the settling of said abrasive particles present within said suspension;

pressurizing said coherent abrasive suspension jet fluid containing said abrasive particles;

allowing said pressurized coherent abrasive suspension jet fluid containing said abrasive particles to expand through a single orifice so as to produce a single, coherent, high velocity, jet stream; and directing said coherent jet stream at a target, said jet stream abrasively impinging upon said target;

wherein said water soluble material which increases the viscosity of said coherent abrasive suspension jet fluid serves to maintain said abrasive particles in suspension, maintain the coherency of said jet stream, and reduce fluid drag.

2. The process of claim 1 wherein said step of pressurizing said coherent abrasive suspension jet fluid comprises:

storing said coherent abrasive suspension jet fluid in a single reservoir; and conducting said coherent abrasive suspension jet fluid from said single reservoir to a single pressurizing cylinder, said pressurizing cylinder having means for receiving a volume of said suspension at a first low pressure, and for discharging said volume at a second high pressure, said second high pressure being greater than said first low pressure.

3. The process of claim 1 wherein said step of allowing said pressurized coherent abrasive suspension jet fluid to expand through a single orifice comprises:

conducting said pressurized coherent abrasive suspension jet fluid containing said abrasive particles through a conduit to a position adjacent said orifice, said conduit capable of containing and conducting said pressurized suspension without significant loss of pressure; and forcing said pressurized coherent abrasive suspension jet fluid containing said abrasive particles through said orifice by maintaining a flow of said pressurized suspension within said conduit, wherein said orifice causes said pressurized suspension to be accelerated and collimated into said jet stream.

4. The process of claim 1 wherein said water soluble material capable of increasing the viscosity of said coherent abrasive suspension jet fluid is a methyl cellulose compound.

5. The process of claim 1 wherein said abrasive particles are abrasive particles selected from a group consisting of garnet, alumina, silica, and silicon carbide.

6. The process of claim 1 wherein said step of pressurizing said coherent abrasive suspension jet fluid results in said pressurized suspension having a pressure of 4,000 psi or greater.

7. The process of claim 1 wherein said orifice has a diameter of 0.003 to 0.020 inches.

8. The process of claim 1 wherein said water soluble material which increases the viscosity of said coherent abrasive suspension jet fluid, increases said viscosity to a level exceeding 9,000 centipoise.

9. The process of claim 1 wherein said water soluble material which increases the viscosity of said coherent abrasive suspension jet fluid is a water soluble material which increases the viscoelasticity of said coherent abrasive suspension jet fluid wherein said water soluble material serves to increase the energy transfer to said target on jet impact.

10. The process of claim 9 wherein said water soluble material which increases the viscoelasticity of said coherent suspension is a methacrylamide compound.

* * * * *